US010117505B1

(12) United States Patent
Alvarez

(10) Patent No.: US 10,117,505 B1
(45) Date of Patent: Nov. 6, 2018

(54) ELECTRONIC CASE ASSEMBLY

(71) Applicant: Alan Nicolas Alvarez, Miami, FL (US)

(72) Inventor: Alan Nicolas Alvarez, Miami, FL (US)

( * ) Notice: Subject to any disclaimer, the term of this patent is extended or adjusted under 35 U.S.C. 154(b) by 0 days.

(21) Appl. No.: 15/803,446

(22) Filed: Nov. 3, 2017

(51) Int. Cl.
*A45F 5/00* (2006.01)
*A45F 5/10* (2006.01)
*A44C 9/00* (2006.01)

(52) U.S. Cl.
CPC ..... *A45F 5/10* (2013.01); *A44C 9/0061* (2013.01); *A45F 2200/0516* (2013.01)

(58) Field of Classification Search
CPC .. A45F 5/00; A45F 3/00; B65D 85/00; B65G 7/12
USPC ..... 224/217
See application file for complete search history.

(56) References Cited

U.S. PATENT DOCUMENTS 6,869,053 B2 * 3/2005 Adams, IV ..... F16B 47/00 248/206.2
6,888,940 B1 * 5/2005 Deppen ..... B60R 11/0241 379/446
7,661,567 B2 * 2/2010 Myers ..... A45C 13/20 224/162
8,479,990 B2 * 7/2013 Chiarini ..... H04M 1/04 235/439
8,550,317 B2 * 10/2013 Hyseni ..... A45F 5/00 224/197
8,579,112 B2 * 11/2013 Bethea ..... A45F 5/00 206/320
8,622,447 B1 * 1/2014 Wirtz ..... H04B 1/385 224/217
8,672,374 B1 3/2014 Webber
D713,140 S * 9/2014 Krupnick ..... D3/218
9,137,915 B2 * 9/2015 McCurdy ..... A45C 13/002
D749,083 S * 2/2016 Senoff ..... D14/451
D765,662 S 9/2016 Kang
D775,619 S 1/2017 Tien
9,653,934 B2 * 5/2017 Forristall ..... H02J 7/0054
9,705,552 B1 * 7/2017 Tall ..... H04B 1/3888
2009/0090750 A1 4/2009 Alcenat
2010/0222118 A1 * 9/2010 Interdanato ..... H04B 1/385 455/575.6
2011/0266316 A1 11/2011 Ghalib et al.
2011/0284599 A1 * 11/2011 Sternick ..... A45F 5/00 224/191
2012/0031937 A1 * 2/2012 Baker ..... A45C 11/00 224/217
2012/0043452 A1 * 2/2012 Karmatz ..... B25G 1/04 248/558
2012/0068043 A1 * 3/2012 Daigle ..... G06F 1/1628 248/682
2012/0168472 A1 * 7/2012 Mathews ..... A45F 3/14 224/162

(Continued)

*Primary Examiner* — Brian D Nash

(57) ABSTRACT

An electronic case assembly includes a case that may contain an electronic device thereby facilitating the electronic device to be manipulated. A pair of magnets is each coupled to the case to magnetically engage a magnetic support surface. In this way the case is selectively retained on the magnetic support surface. A finger loop is pivotally coupled to the case. The finger loop is selectively positioned in a first position to insertably receive a finger thereby inhibiting the case from being dropped. The finger loop is selectively positioned in a second position to abut a support surface. In this way the case is reclined on the support surface for viewing the electronic device.

7 Claims, 4 Drawing Sheets

(56) References Cited

U.S. PATENT DOCUMENTS

| | | | | |
|---|---|---|---|---|
| 2013/0079070 | A1* | 3/2013 | Losiewicz | H04B 1/3833 455/575.8 |
| 2013/0146625 | A1* | 6/2013 | Karle | A45F 5/00 224/217 |
| 2013/0148271 | A1* | 6/2013 | Huang | H04B 1/3888 361/679.01 |
| 2013/0279098 | A1* | 10/2013 | Cho | H05K 7/00 361/679.01 |
| 2014/0084034 | A1* | 3/2014 | Wangercyn, Jr. | H04B 1/385 224/217 |
| 2014/0166707 | A1 | 6/2014 | Leisey-Batrsch | |
| 2014/0335922 | A1 | 11/2014 | West et al. | |
| 2014/0354218 | A1* | 12/2014 | Kaynar | H02J 7/0044 320/107 |
| 2015/0342328 | A1* | 12/2015 | Seger | A45F 5/004 224/162 |
| 2016/0049983 | A1* | 2/2016 | Ripka | H04B 1/385 455/575.6 |
| 2016/0372973 | A1* | 12/2016 | Fitzgerald | H02J 50/10 |

* cited by examiner

ELECTRONIC CASE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to case devices and more particularly pertains to a new case device for enhancing gripping an electronic device.

BRIEF SUMMARY OF THE INVENTION

An embodiment of the disclosure meets the needs presented above by generally comprising a case that may contain an electronic device thereby facilitating the electronic device to be manipulated. A pair of magnets is each coupled to the case to magnetically engage a magnetic support surface. In this way the case is selectively retained on the magnetic support surface. A finger loop is pivotally coupled to the case. The finger loop is selectively positioned in a first position to insertably receive a finger thereby inhibiting the case from being dropped. The finger loop is selectively positioned in a second position to abut a support surface. In this way the case is reclined on the support surface for viewing the electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
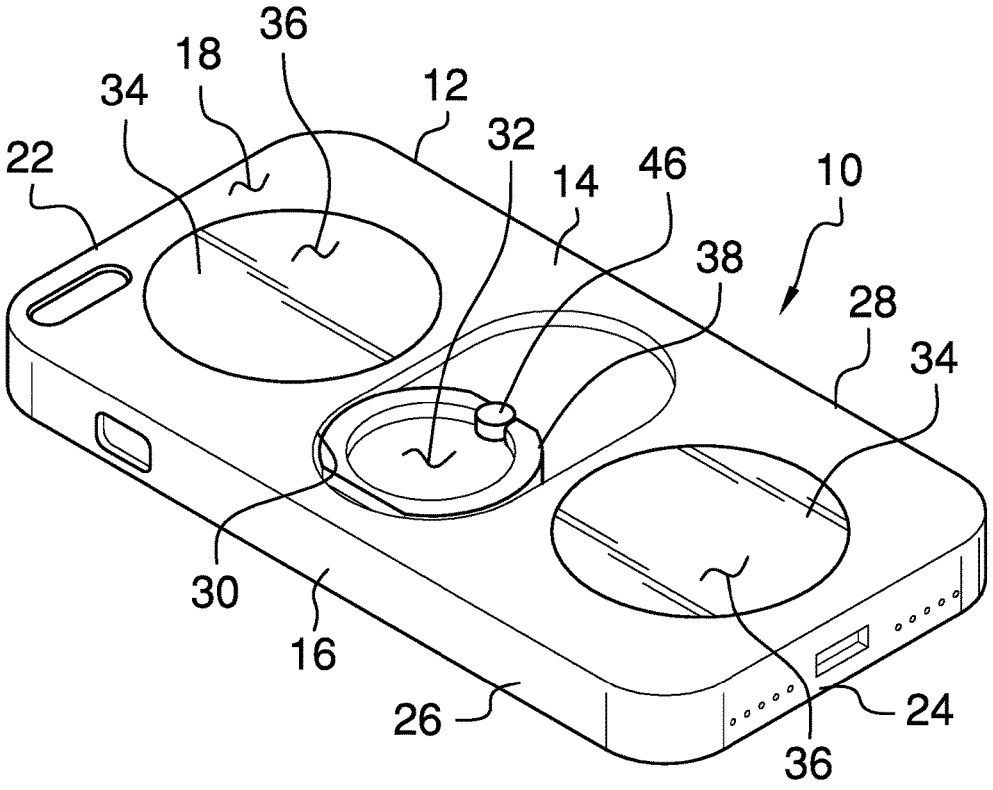
FIG. 1 is a back perspective view of an electronic case assembly according to an embodiment of the disclosure.
Figure 2:
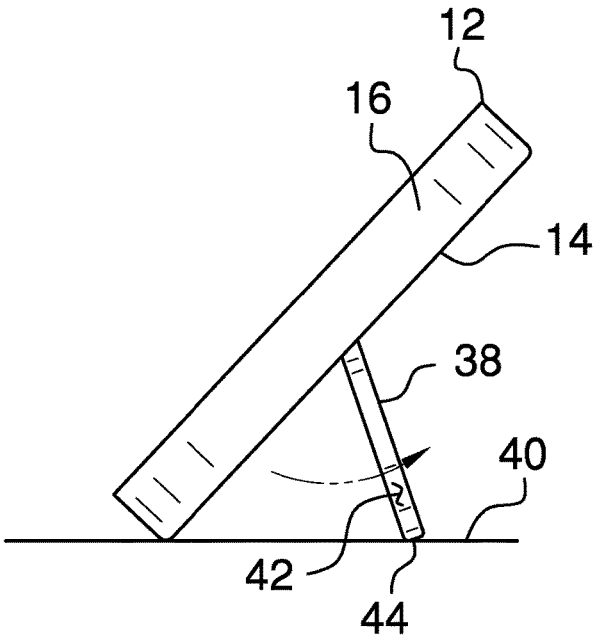
FIG. 2 is a perspective in-use view of an embodiment of the disclosure showing a finger loop in a second position.
Figure 3:
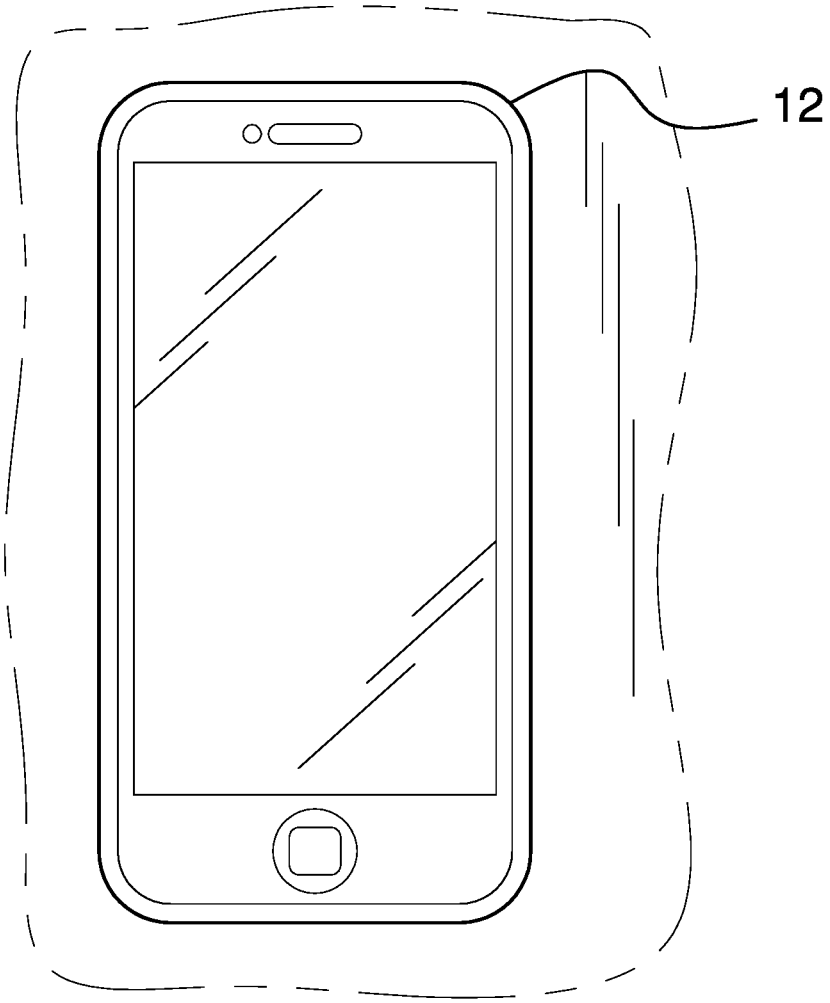
FIG. 3 is a front view of an embodiment of the disclosure.
Figure 4:
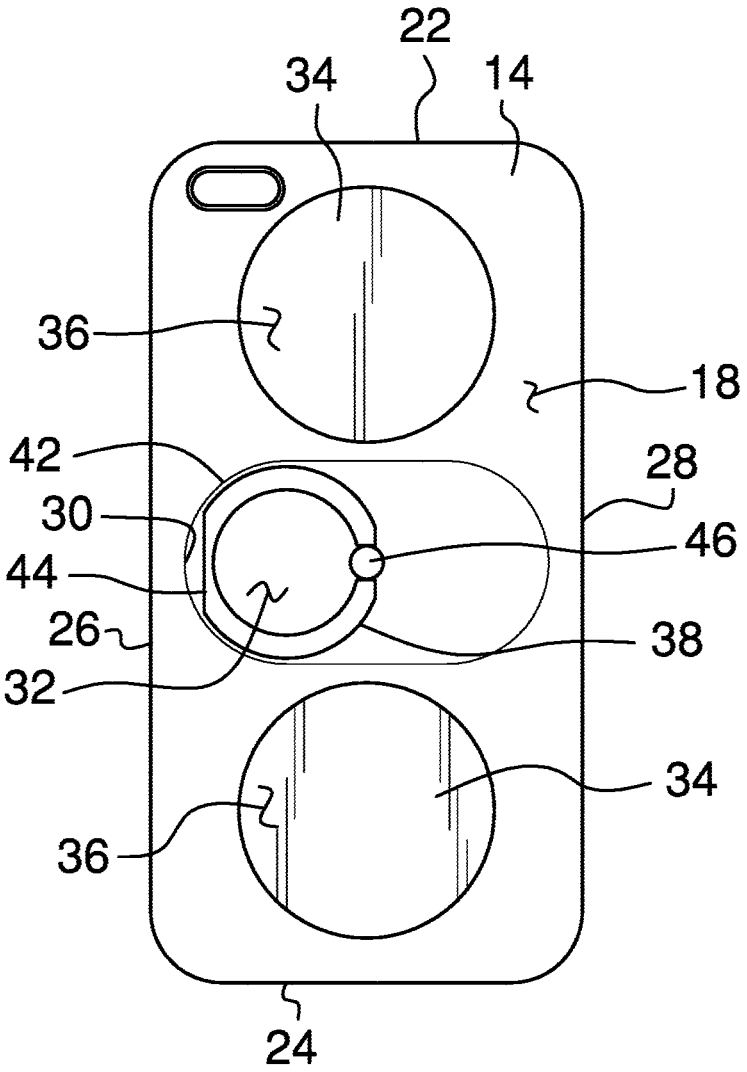
FIG. 4 is a back view of an embodiment of the disclosure showing a finger loop in a stored position.
Figure 5:
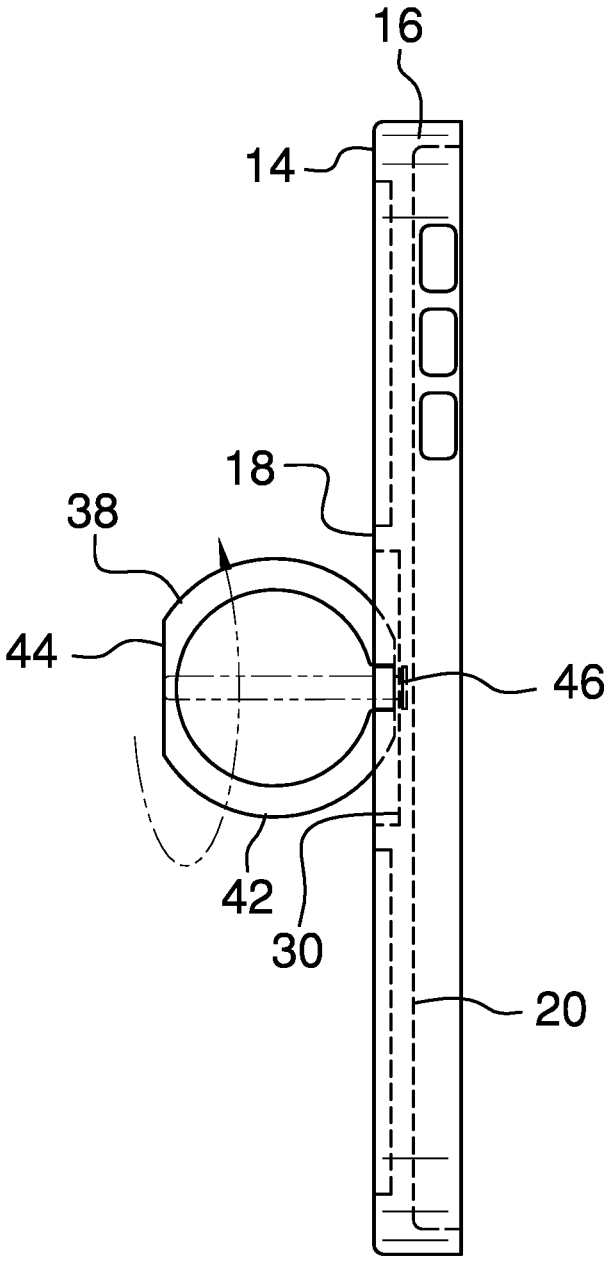
FIG. 5 is a right side phantom view of an embodiment of the disclosure showing a finger loop in a first position.

With reference now to the drawings, and in particular to FIGS. 1 through 5 thereof, a new case device embodying the principles and concepts of an embodiment of the disclosure and generally designated by the reference numeral 10 will be described.

As best illustrated in FIGS. 1 through 5, the electronic case assembly 10 generally comprises a case 12 that may contain an electronic device thereby facilitating the electronic device to be manipulated. The electronic device may be a smartphone, a tablet and any other electronic device that has an electronic display. The case 12 has a basal wall 14 and a perimeter wall 16 extending away from the basal wall 14. The perimeter wall 16 may have a plurality of openings and each of the openings may facilitate access to controls on the electronic device. Moreover, the case 12 may be a smart phone case of any conventional design.

The basal wall 14 has a first surface 18 and a second surface 20 and the electronic device abuts the second surface 20 when the electronic device is positioned in the case 12. The perimeter wall 16 has a top side 22, a bottom side 24, a first lateral side 26 and a second lateral side 28. The first surface 18 has a well 30 extending toward the second surface 20 and the well 30 is centrally positioned between the top side 22 and the bottom side 24. The well 30 is elongated to extend substantially between the first lateral side 26 and the second lateral side 28 and the well 30 has a lower bounding surface 32.

A pair of magnets 34 is each coupled to the case 12 to magnetically engage a magnetic support surface. Each of the magnets 34 has an exposed surface 36. Moreover, each of the magnets 34 is recessed into the first surface 18 of the basal wall 14 having the exposed surface 36 corresponding to each of the magnets 34 being aligned with the first surface 18. The exposed surface 36 magnetically engages the magnetic support surface.

A finger loop 38 is pivotally coupled to the case 12. The finger loop 38 is selectively positioned in a first position to insertably receive a finger. In this way the finger loop 38 inhibiting the case 12 from being dropped when the finger is extended through the finger loop 38. The finger loop 38 is selectively positioned in a second position. Moreover, the finger loop 38 abuts a support surface 40 thereby standing the case 12 on the support surface 40 for viewing the electronic device when the finger loop is positioned in the second position.

The finger loop 38 has an outside surface 42 and the outside surface 42 is continuous such that the finger loop 38 forms a closed loop. The outside surface 42 has a flattened portion 44. Additionally, the finger loop 38 is positioned in the well 30 when the finger loop 38 is positioned in a stored position. The flattened portion 44 of the finger loop 38 is directed toward a selected one of the first lateral side 26 and the second lateral side 28 of the case 12 when the finger loop 38 is positioned in the stored position. The finger loop 38 is oriented perpendicular to a plane lying on the first surface 18 when the finger loop 38 is positioned in the first position. Thus, the finger may be extended through the finger loop 38 when the case 12 is gripped.

The finger loop 38 is oriented to form an acute inside angle with the plane when the finger loop 38 is positioned in the second position. The case 12 is positioned on the support surface 40 such that each of the flattened portion 44 and the first lateral side 26 of the case 12 abuts the support surface 40. In this way the case 12 is reclined in a landscape orientation for viewing the electronic device. The support surface 40 may be a table top or the like.

A pin 46 is rotatably coupled to and extends away from the case 12. The finger loop 38 is pivotally coupled to the pin 46 such. In this way the finger loop 38 is selectively positionable between the first, second and stored positions. The pin 46 is positioned on the lower bounding surface 32 of the well 30 and the pin 46 is centrally positioned in the well 30.

In use, the electronic device is positioned in the case 12 to protect the electronic device from impact damage. The finger loop 38 is selectively positioned in the first position thereby facilitating a finger to be extended through the finger loop 38 when the case 12 is gripped. In this way the finger loop 38 inhibits the case 12 from being dropped. The finger loop 38 is selectively positioned in the second position to retain the case 12 in a landscape orientation on the support surface 40. In this way the electronic device is positioned for viewing. The finger loop 38 is selectively positioned in the stored position and the case 12 is selectively positioned against a magnetic support surface 40. The magnets 34 magnetically engage the magnetic support surface 40 to retain the case 12 on the magnetic support surface 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electronic case assembly being configured to contain an electronic device, said assembly comprising:

a case being configured to contain an electronic device thereby facilitating the electronic device to be manipulated, said case having a basal wall and a perimeter wall extending away from said basal wall, basal wall having a first surface and a second surface, said second surface being configured to abut the electronic device when the electronic device is positioned in said case, said perimeter wall having a top side, a bottom side, a first lateral side and a second lateral side, said first surface having a well extending toward said second surface, said well being centrally positioned between said top side and said bottom side, said well being positioned closer to said first lateral side than said second lateral side, said well having a lower bounding surface;

a pair of magnets, each of said magnets being coupled to said case wherein said case is configured to magnetically engage a magnetic surface; and a finger loop being pivotally coupled to said case, said finger loop being selectively positioned in a first position wherein said finger loop is configured to insertably receive a finger thereby inhibiting said case from being dropped, said finger loop being selectively positioned in a second position extending from said case wherein said finger loop is configured to abut a support surface thereby standing said case on the support surface for viewing the electronic device.

2. The assembly according to claim 1, wherein said finger loop has an outside surface, said outside surface being continuous such that said finger loop forms a closed loop, said outside surface having a flattened portion, said finger loop being positioned in said well when said finger loop is positioned in a stored position.

3. The assembly according to claim 2, wherein said finger loop is oriented perpendicular to a plane lying on said first surface when said finger loop is positioned in said first position.

4. The assembly according to claim 2, wherein said finger loop is oriented to form an acute inside angle with said plane when said finger loop is positioned in said second position wherein each of said flattened portion and said first lateral side of said case being configured to abut the support surface thereby facilitating said case to be reclined for viewing the electronic device.

5. The assembly according to claim 1, further comprising a pin being coupled to and extending away from said case, said finger loop being pivotally coupled to said pin such that said finger loop is selectively positionable between said first, second and stored positions, said pin being positioned on said lower bounding surface of said well.

6. An electronic case assembly being configured to contain an electronic device, said assembly comprising:

a case being configured to contain an electronic device thereby facilitating the electronic device to be manipulated, said case having a basal wall and a perimeter wall extending away from said basal wall, basal wall having a first surface and a second surface, said second surface being configured to abut the electronic device when the electronic device is positioned in said case, said perimeter wall having a top side, a bottom side, a first lateral side and a second lateral side;

a pair of magnets, each of said magnets being coupled to said case wherein said case is configured to magnetically engage a magnetic surface;

a finger loop being pivotally coupled to said case, said finger loop being selectively positioned in a first position wherein said finger loop is configured to insertably receive a finger thereby inhibiting said case from being dropped, said finger loop being selectively positioned in a second position extending from said case wherein said finger loop is configured to abut a support surface thereby standing said case on the support surface for viewing the electronic device; and wherein each of said magnets has an exposed surface, each of said magnets being recessed into said first surface of said basal wall having said exposed surface corresponding to each of said magnets being aligned with said first surface, said exposed surface being configured to magnetically engage the magnetic support surface.

7. An electronic case assembly being configured to contain an electronic device, said assembly comprising:

a case being configured to contain an electronic device thereby facilitating the electronic device to be manipulated, said case having a basal wall and an perimeter wall extending away from said basal wall, basal wall having a first surface and a second surface, said second surface being configured to abut the electronic device when the electronic device is positioned in said case, said perimeter wall having a top side, a bottom side, a first lateral side and a second lateral side, said first surface having a well extending toward said second surface, said well being centrally positioned between said top side and said bottom side, said well being positioned closer to said first lateral side than said second lateral side, said well having a lower bounding surface;

a pair of magnets, each of said magnets being coupled to said case wherein said case is configured to magnetically engage a magnetic surface, each of said magnets having an exposed surface, each of said magnets being recessed into said first surface of said basal wall having said exposed surface corresponding to each of said magnets being aligned with said first surface, said exposed surface being configured to magnetically engage the magnetic support surface;

a finger loop being pivotally coupled to said case, said finger loop being selectively positioned in a first position wherein said finger loop is configured to insertably receive a finger thereby inhibiting said case from being dropped, said finger loop being selectively positioned in a second position extending from said case wherein said finger loop is configured to abut a support surface thereby standing said case on the support surface for viewing the electronic device, said finger loop having an outside surface, said outside surface being continuous such that said finger loop forms a closed loop, said outside surface having a flattened portion, said finger loop being positioned in said well when said finger loop is positioned in a stored position, said finger loop being oriented perpendicular to a plane lying on said first surface when said finger loop is positioned in said first position, said finger loop being oriented to form an acute inside angle with said plane when said finger loop is positioned in said second position wherein each of said flattened portion and said first lateral side of said case being configured to abut the support surface thereby facilitating said case to be reclined for viewing the electronic device; and a pin being coupled to and extending away from said case, said finger loop being pivotally coupled to said pin such that said finger loop is selectively positionable between said first, second and stored positions, said pin being positioned on said lower bounding surface of said well.

* * * * *